US005732642A

United States Patent [19]

DeSilva

[11] Patent Number: 5,732,642

[45] Date of Patent: Mar. 31, 1998

[54] WINDSURFER SAIL DEVICE

[76] Inventor: James DeSilva, 298 Commonwealth Ave., G1, Boston, Mass. 02115

[21] Appl. No.: 642,911

[22] Filed: May 6, 1996

[51] Int. Cl.[6] ..... B63H 9/06

[52] U.S. Cl. ..... 114/103

[58] Field of Search ..... 114/102, 103, 114/39.2

[56] References Cited

U.S. PATENT DOCUMENTS

| | | | |
|---|---|---|---|
| 585,226 | 6/1897 | Pope | 114/103 |
| 3,954,076 | 5/1976 | Fracker | 114/103 |
| 4,448,144 | 5/1984 | Senoo et al. | 114/102 |
| 4,612,868 | 9/1986 | Reynolds | 114/103 |
| 4,854,255 | 8/1989 | Kief | 114/39.1 |
| 4,964,353 | 10/1990 | Morrelli | 114/39.2 |
| 4,967,680 | 11/1990 | Dailey et al. | 114/104 |
| 5,031,560 | 7/1991 | Stearns, IV | 114/103 |
| 5,042,412 | 8/1991 | Fouch | 114/39.2 |
| 5,123,368 | 6/1992 | Tran et al. | 114/103 |

FOREIGN PATENT DOCUMENTS

| | | | |
|---|---|---|---|
| 2755991 | 6/1979 | Germany | 114/103 |
| 7906386 | 2/1981 | Netherlands | 114/103 |

*Primary Examiner*—Sherman Basinger

*Attorney, Agent, or Firm*—Duane, Morris & Heckscher LLP

[57] ABSTRACT

A windsurfer sail with an extendable wind range and easier uphauling capability. Sealable openings on the body of the sail provide for adjustability by the operator.

2 Claims, 3 Drawing Sheets

WINDSURFER SAIL DEVICE

BACKGROUND OF THE INVENTION

1. Field of the Invention

This invention relates to an article which extends the wind range of a sail and assists in the uphauling of the sail. More specifically, this invention provides a sail with a removable portion which allows for passage of air and water.

2. Description of Related Art

There are thousands of windsurfers in use today all over the world. Windsurfers consist of a surfboard-like hull which the rider stands on, and are propelled by a "rig," consisting of a sail, mast and boom, which the rider holds onto. A flexible joint or universal joint, connects the two together.

Due to the unstable nature of water as a riding surface, windsurfer operators commonly lose control or "dump" their rig. When a windsurfer operator "dumps" a rig, both the windsurfer operator and the rig are in the water. When dumped, it is imperative to get the rig out of the water and in a sailing position as quickly and easily as possible for reasons including safety in navigation, personal safety, fear of hypothermia, and enjoyment of the sport itself.

Unless a windsurfer operator is extremely strong or experienced, or can use his/her body weight to an advantage to pull the sail out of the water, it is difficult to get the sail up in a sailing position. Other problems like unexpected high winds may cause problems even for an experienced sailor. High winds can overpower the sail, making the windsurfer difficult to control.

Sails of different sizes have different wind ranges, with smaller sails being more appropriate for heavy wind conditions. Larger sails are suited for light wind conditions in order to capture more wind with greater surface area. The process of choosing a sail to match the wind conditions is always difficult since weather conditions can change so rapidly. It is desirable to have a sail with an adjustable wind range to counteract rapid weather wind range changes.

The basic patent for a wind propelled surfboard is U.S. Pat. No. 3,487,800 by Schweitzer and Drake. This patent describes wind propulsion means for vehicles including watercraft, iceboats and landcraft. This patent also describes all the steering and control to be accomplished through the sail. In the event of sudden or excessive winds, the user needs only to release the sail and it will fall in any direction, freeing the vehicle from any propulsive force. This patent, however, does not provide for any righting assist device or wind range extender as described herein.

A patent utilizing a righting device is U.S. Pat. No. 3,865,061 to Newman. This device and method is used to right a catamaran, which is more difficult than righting the sail of a windsurfer. This patent has an embodiment involving pulleys that right a mast of a catamaran. The catamaran features two side shroud cables and one cable running fore and aft to the mast tip.

A French patent 2,575-720A to Biasini describes a device to assist righting a sail and mast of a windsurfer. This device is a mobile beam articulated to a mast base and acts as a pull pivot.

U.S. Pat. No. 5,042,412 Aug. 27, 1991 to Fouch discloses a device for aiding in uphauling a sail via a pulley mounted on the mast that is rotatably attached to the mast. A rope is threaded through said pulley(s) with one end attached to the harness worn by the windsurfer operator. However, these prior art devices use complicated mechanical or pulley mechanisms to facilitate righting of the sail.

Thus, it is desirable to have a device for extending the wind range of a windsurfer sail and to improve the ease of uphauling of the sail which does not use complicated mechanical parts.

SUMMARY OF THE INVENTION

The present invention provides a windsurfer rig righting aid and wind range extending article that uses a sealable opening in the body of the sail.

It is the object of the present invention to provide a device that aids in righting a windsurfer rig.

It is a further object of the present invention to provide a device which extends the wind range of a windsurfer sail.

DETAILED DESCRIPTION OF THE PREFERRED EMBODIMENT

Figure 3:
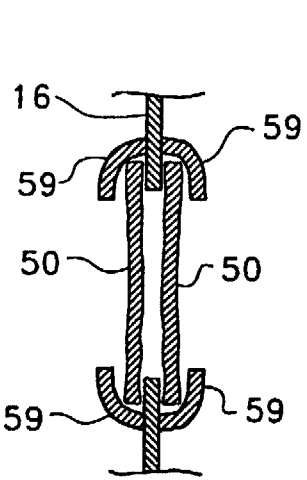
FIG. 3 is a view along line 3—3 in FIG. 2.

The preferred embodiment will be described with reference to the drawing figures where like numerals represent like elements throughout.

Figure 1B:
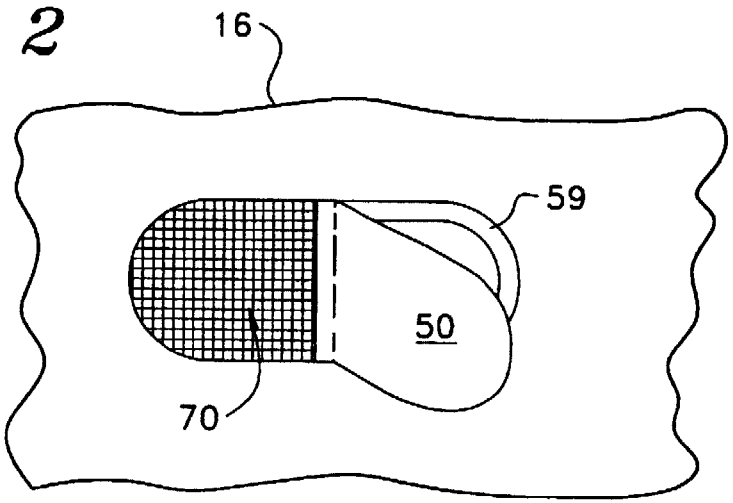
FIG. 1*b* is a side view of the windsurfer sail with reinforcing mesh.
Figure 1A:
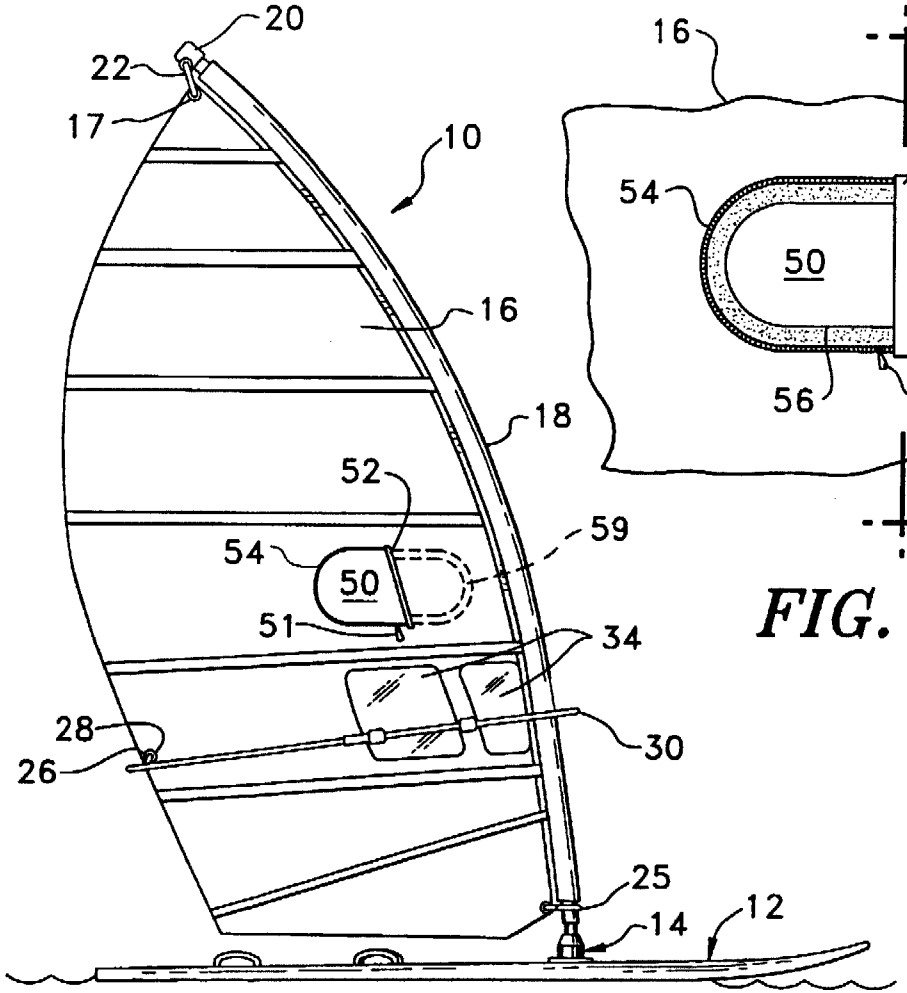
FIG. 1*a* is a side view showing a windsurfer sail made in accordance with the teachings of the present invention.

Referring to FIG. 1*a*, there is shown a windsurfer 10 which is composed generally of a sailboard 12, a mast 14, and a sail body 16. The mast 14 has a leading or luff edge 18. The upper end of the mast may terminate in a bulbous portion which is referred to as a head cap 20. Connected with the cap 20 is an adjustable line or strap 22. The adjustable line or strap engages with an eyelet 17 mounted within the sail body 16.

Included with the sail body 16 at the leech edge is an eyelet 28. Eyelet 28 is located directly adjacent the boom 30 which is to be handled by the operator and is to be used to effect steering of the windsurfer as it moves across the water. An outhaul line 26 connects eyelet 28 to boom 30. Connecting the eyelet 29 to the mast 14 is downhaul line 25. The sail body 16 includes a pair of windows 34 which are located directly adjacent the boom 30.

Positioned generally in the center of the sail body 16 is a closable flap 50 with the flap 50 hinged at one end and releasable around the remaining of its perimeter. A flexible hinge 52 connects the flap 50 to the sail 16 as a zipper 54 surrounds the releasable perimeter of flap 50. The flap 50 is released by grasping the zipper handle 51 and successively unzipping around the perimeter of flap 50. Unzipping allows for increased air flow through the sail body 16, relieving pressure on the rider.

Opening the flap 50 creates extra air flow through the sail body 16. The extra air flow through the sail body 16 enables the sail body 16 to function like a sail of smaller size. The opening allows more air to flow through the sail body 16 thus preventing the overpowering of the user. If wind speeds lower or a new rider with greater skill or of heavier weight takes over, the opening can be closed using the flap 50 so as to have the original characteristics of the sail. In addition, when the sail is placed in the water, the opening left by the flap 50 creates an area to facilitate flow of water which has collected on the sail body 16. This flow of water aids the windsurfer operator in lifting the sail body 16 out of the water in order to begin sailing.

As shown in FIG. 1*b*, the opening in the sail 16 is filled with a porous mesh 70. The mesh 70 protects the integrity of sail 16. By bonding the edges of the opening created in the sail 16, the mesh provides structural support for the sail 16. The mesh 70 also provides for controlled flow of air or water through the opening. Rather than having streams of wind or water flow directly through the opening, the flow is diffused and thus more regulated with the mesh 70.

The mesh 70 is preferably a non-porous material to prevent collection and retention of fluid in the mesh. The mesh may be constructed of similar material as the sail body 16.

Figure 2:
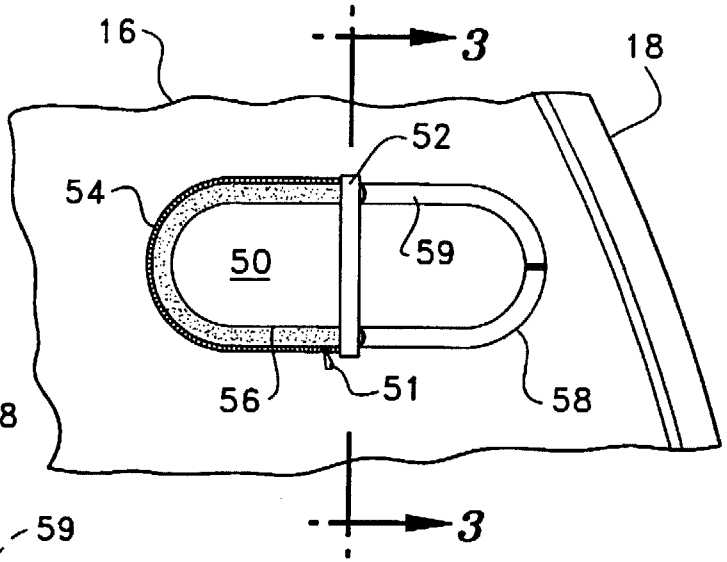
FIG. 2 is a detailed view of the sealable flap.

Referring to FIGS. 2–3, there is shown positioned around the general perimeter of both sides of flaps 50 velcro® fastener material 56. Upon unzipping the flaps 50 completely, the flaps 50 are folded about the hinge 52 and placed against the velcro® fastener material 58 secured on the sail body 16. Interaction of the velcro®hook members 56 with the velcro® loop members 58 secure the flaps 50 to the sail body 16. The interaction of the velcro® fastener members 56 and 58 prevents unwanted movement of the flaps 50 about the sail body 16. Securing tabs 59 further hold the flaps 50 against the sail body 16. The inside surface of securing tabs 59 are further provided with velcro® fastener material to interact with fastener material disposed on the edges of flaps 50.

Figure 5:
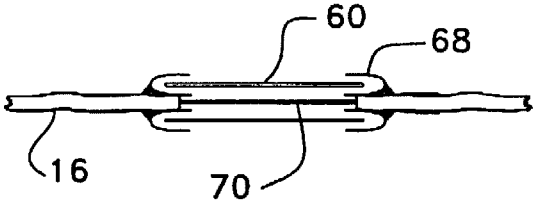
FIG. 5 is a view along line 5—5 in FIG. 4.
Figure 6:
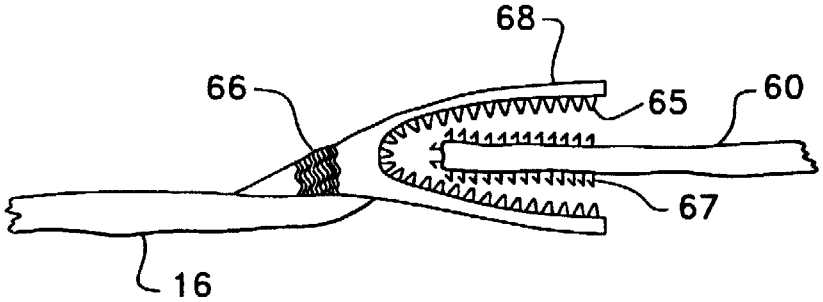
FIG. 6 is an enlarged view of the flap connection.
Figure 4:
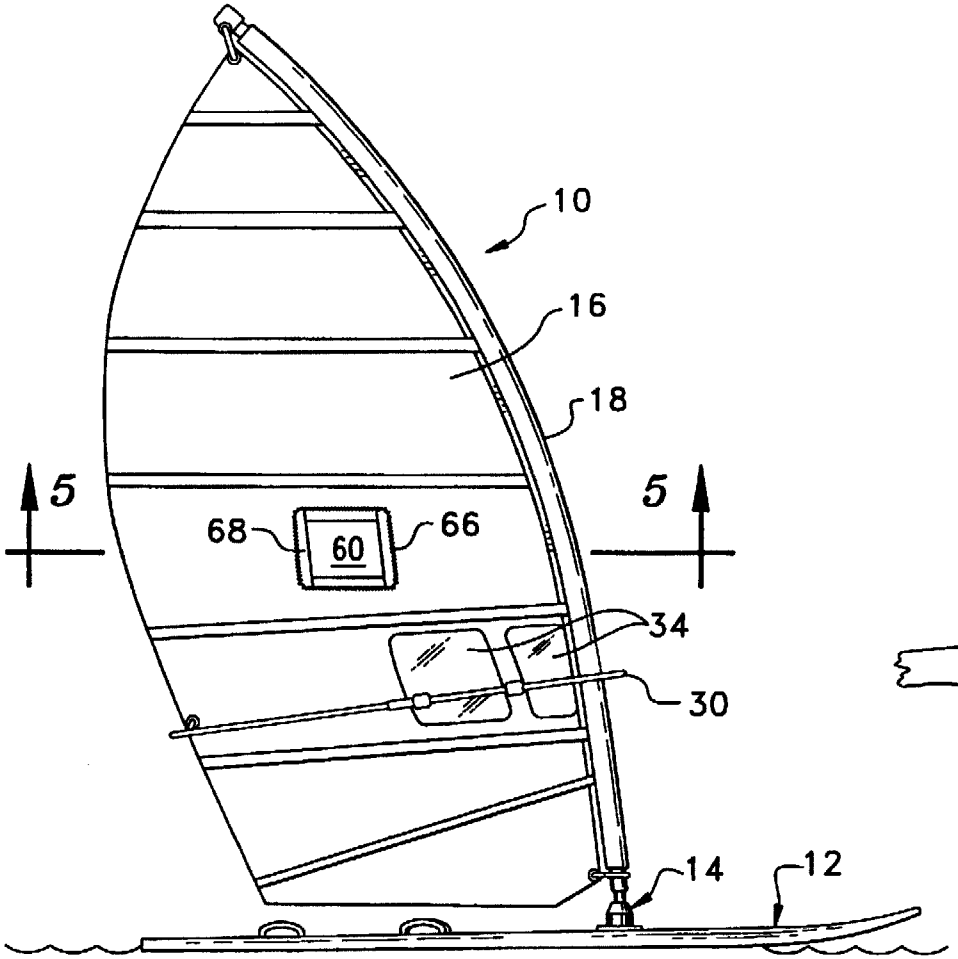
FIG. 4 is a view of an alternate embodiment of the present invention.

An alternate embodiment of the invention is shown in FIG. 4. The sail 16 uses completely removable panels 60 to cover the opening in the sail 16. Preferably, two opposing panels 60 are used on both sides of the sail 16. Flap members 68 secure panels 60 to the sail 16. Velcro® fastener material lines the inner portion of the flap members 68. As shown in FIGS. 5–6, velcro® fastener loop members 65 protrude from the inside portion of the flaps 68. The velcro® loop members 65 interact with velcro® hook members 67 displaced along the ends of the panels 60. The flaps 68 reinforce the connection between the flap 50 and the sail body 16 and prevent unwanted release of the flap 50. As discussed earlier herein, the opening in sail 16 is reinforced with mesh 70.

Figure 7:
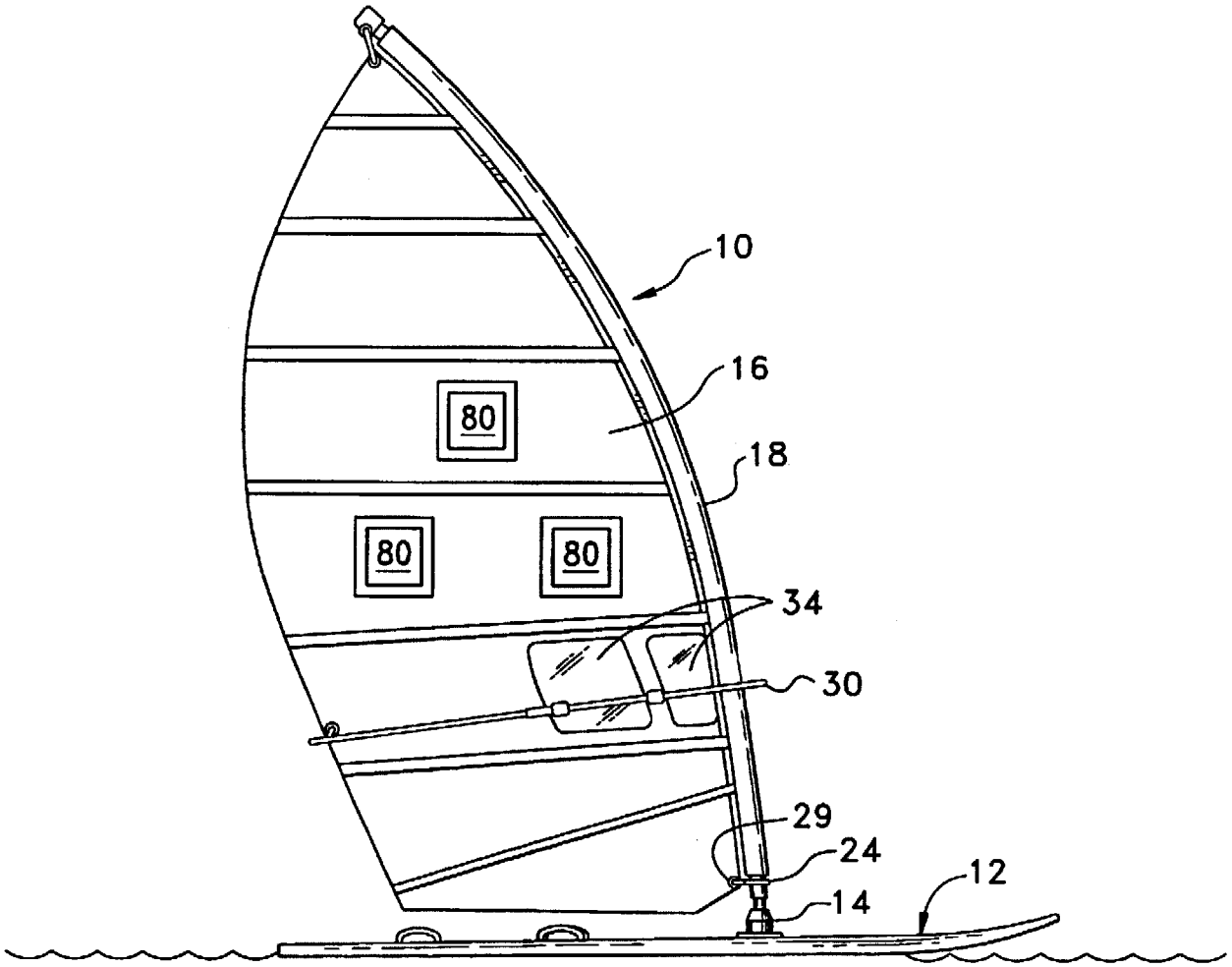
FIG. 7 is a side view of a fourth embodiment of the present invention.

While the preferred embodiment of the sail body 16 utilizes a single closable opening, an alternative embodiment of the invention employs a plurality of closable openings disposed on the sail body 16. As shown in FIG. 7, the sail body 16 includes sealable openings 80. The openings 80 may all be left closed, all opened or selectively opened and closed depending on the varying wind conditions and relative skill of the operator. The openings 80 may use hinged flaps or removable panels as discussed herein.

While the present invention has been described in terms of the preferred embodiment, other variations which are within the scope of the invention as outlined in the claims will be apparent to those skilled in the art.

I claim:

1. A windsurfer sail comprising:

means for increasing the wind range and uphauling ease of said sail, said means including an opening having an open interior disposed along the surface of said sail;

a flap hingedly attached at one side to said opening of said sail and being sized so as to cover said opening, a zipper for securing said flap to said sail;

retaining means for holding said flap against said sail when said flap is fully unzipped; and a porous mesh plane, said mesh plane having longitudinal and transverse members fixedly attached to said periphery of said opening and across said open interior of said opening.

2. A windsurfer sail comprising:

means for increasing the wind range and uphauling ease of said sail, said means including an opening having an open interior disposed along the surface of said sail;

a flap hingedly attached at one side to said opening of said sail and being sized so as to cover said opening;

hook and loop fastener material for securing said flap to said sail;

retaining means for holding said flap against said sail when said flap is positioned to uncover said opening; and a porous mesh plane, said mesh plane having longitudinal and transverse members fixedly attached to said periphery of said opening and across said open interior of said opening.

* * * * *